US006402643B1

(12) United States Patent
Gill

(10) Patent No.: US 6,402,643 B1
(45) **Date of Patent: *Jun. 11, 2002**

(54) FOLDING SOCCER GOAL

(76) Inventor: Sukhinder Paul Timothy Singh Gill, 11417 Somerset Crescent, Delta, British Columbia (CA), V4E 2P1

( * ) Notice: Subject to any disclaimer, the term of this patent is extended or adjusted under 35 U.S.C. 154(b) by 0 days.

This patent is subject to a terminal disclaimer.

(21) Appl. No.: 09/347,880

(22) Filed: Jul. 6, 1999

Related U.S. Application Data

(63) Continuation of application No. 08/742,405, filed on Nov. 4, 1996, now Pat. No. 5,954,600.

(51) Int. Cl.[7] ..... A63B 63/00
(52) U.S. Cl. ..... 473/478; 273/400
(58) Field of Search ..... 473/471, 478, 473/476, 477, 400

(56) References Cited

U.S. PATENT DOCUMENTS

| | | | | |
|---|---|---|---|---|
| 2,449,708 A | | 9/1948 | Lindsay | |
| 3,698,715 A | * | 10/1972 | Browning et al. | 473/478 |
| 4,127,272 A | | 11/1978 | Pennell | |
| 4,407,507 A | | 10/1983 | Caruso | |
| 4,420,158 A | | 12/1983 | Klock et al. | |
| 4,567,011 A | * | 1/1986 | Nalle | 264/504 |
| 4,842,284 A | * | 6/1989 | Rushing et al. | 273/395 |
| 5,048,844 A | | 9/1991 | Haseltine | |
| 5,080,375 A | | 1/1992 | Moosavi | |
| 5,181,725 A | | 1/1993 | Leras et al. | |
| 5,186,469 A | | 2/1993 | Terris | |
| 5,269,527 A | | 12/1993 | Noval | |
| 5,273,292 A | | 12/1993 | Pardi | |
| 5,308,083 A | | 5/1994 | Grunfeld | |
| 5,316,314 A | | 5/1994 | Wilson | |
| 5,372,368 A | | 12/1994 | Pavonetti | |
| 5,427,381 A | * | 6/1995 | Macaluso et al. | 273/400 |
| 5,431,411 A | | 7/1995 | Padilla | |
| 5,433,433 A | | 7/1995 | Armell | |
| 5,496,040 A | | 3/1996 | Amburgey | |
| 5,533,733 A | | 7/1996 | Dimbeck | |
| 5,539,957 A | | 7/1996 | Schmidt | |
| 5,586,768 A | * | 12/1996 | Pavonetti | 473/478 |
| 5,599,024 A | | 2/1997 | Acuff et al. | |
| 5,690,339 A | * | 11/1997 | Chen | 473/400 |
| 5,830,089 A | * | 11/1998 | Halter et al. | 473/478 |
| 5,839,733 A | | 11/1998 | Meeks et al. | |
| 5,842,939 A | * | 12/1998 | Pui et al. | 473/478 |
| 5,842,940 A | * | 12/1998 | Macaluso | 473/478 |
| 5,857,679 A | * | 1/1999 | Ringe et al. | 273/395 |
| 5,857,928 A | * | 1/1999 | Stewart | 473/446 |
| 5,863,266 A | * | 1/1999 | Starnes | 473/471 |
| 5,902,195 A | * | 5/1999 | Pavonetti | 473/478 |
| 5,902,196 A | * | 5/1999 | Chorneyko | 473/478 |

FOREIGN PATENT DOCUMENTS

| | | |
|---|---|---|
| DE | 1578540 | 11/1970 |
| DE | 26 50 289 A1 | 11/1978 |
| DE | 2847701 | 5/1980 |
| WO | WO 95/21002 | 8/1995 |
| WO | WO 95/32031 | 11/1995 |

* cited by examiner

*Primary Examiner*—Paul T. Sewell
*Assistant Examiner*—M. Chambers
(74) *Attorney, Agent, or Firm*—Knobbe Martens Olson & Bear LLP

(57) ABSTRACT

A folding soccer goal, consisting of a goalpost, backstay bars, and a net, wherein the goalpost has a horizontal crossbar and two vertical posts foldably attached to the crossbar; the backstay bars foldably attach to the goalpost and extend outward and downward therefrom; a hinged foot assembly is connected to the bottom of each vertical post wherein the foot is adapted for attachment to a playing surface; also disclosed is a method for erecting a soccer goal including the steps of laying the goal on the playing surface, positioning the feet against the playing surface, attaching the feet to the playing surface, raising the posts about the hinges to a substantially vertical position over the feet, and securing the posts in a substantially vertical position.

4 Claims, 9 Drawing Sheets

FOLDING SOCCER GOAL

This application is a continuation of U.S. patent application Ser. No. 08/742,405, filed on Nov. 4, 1996, now U.S. Pat. No. 5,954,600 issued Sep. 21, 1999.

BACKGROUND OF THE INVENTION

Soccer is a well known sport worldwide and is increasing in popularity. One of its appealing characteristics is its simplicity: a ball and a goal are the only required equipment. In much of the world, community parks and playgrounds commonly include permanently installed soccer goals. Yet in many areas most playgrounds, parks and other surfaces suitable for playing soccer lack soccer goals. It is therefore desirable to provide a portable soccer goal so that games of soccer may be played in such settings.

Some attempts have been made to develop portable soccer goals. A relatively early example is U.S. Pat. No. 4,127,272 to Pennell. The Pennell goal is made of several separable units and requires at least two people for assembly and disassembly. It uses several loose fasteners, including screws, bolts and clip pins, and is "portable" only in a station wagon or pickup truck. Several later goals also require the assembly of numerous separate pieces (U.S. Pat. No. 4,407,507 to Caruso, U.S. Pat. No. 5,080,375 to Moosavi).

Soccer goals consisting of numerous pieces have the distinct disadvantage that they are difficult and slow to set up. Loose fasteners may require tools for driving or tightening, and may also become lost in transit or storage or during assembly of a goal on a turf playing field.

In some portable goal designs, a balance was struck between portability and ease of assembly. A goal would be broken down into few separate pieces or one piece, but the resulting piece or pieces would be large and cumbersome (U.S. Pat. No. 5,431,411 to Padilla, U.S. Pat. No. 5,496,040 to Amburgey et al.). Other attempts sacrificed the shape, structure, or dimensions of authentic soccer goals to enhance portability and/or ease of setup (U.S. Pat. No. 4,420,158 to Klock, U.S. Pat. No. 5,048,844 to Haseltine, U.S. Pat. No. 5,269,527 to Noval, U.S. Pat. No. 5,433,433 to Armell).

Several of these designs do not look or behave like a genuine soccer goal, and can provide a disadvantage when players become accustomed to attacking or defending a goal with a configuration that is different from that of the goals they will use in more standard soccer venues.

Some recent goals have taken other approaches in balancing the competing design objectives. One strategy is to rely on numerous hinges, supporting angles, and beam architecture theory to devise a rigid but collapsible goalpost. U.S. Pat. No. 5,372,368 to Pavonetti describes a multiply hinged soccer goal. This soccer goal has a plurality of pieces, some of which are connected by hinges at one end and have a second free end that must be inserted or otherwise connected to adjacent parts of the goal during setup. Goal setup also involves connecting crossbar members together until the cross bar members attain the attributes of a fixed beam. The Pavonetti goal also has several telescoping members, such as the net supporting arms. In addition, the soccer goal is supported by two flat base units that connect the front of the goal to the rear of the goal on each side. These units therefore attach to the playing surface, the rear supports, and the uprights.

The several connectible net supporting arms complicate the setup and breakdown of the goal. The telescoping members provide a disadvantage if they jam or bend, because they may then fail to properly telescope.

Base members connecting the net supports to the uprights create a significant disadvantage when the goal is installed on a playing surface that is not flat, because the uprights rise from the base members at a 90° angle. This relationship of relatively long straight base members connected to the uprights dictates that, if the playing surface slopes, the uprights will proportionally deviate from a substantially vertical position.

The Pavonetti goal has the additional disadvantage that the net is attached to the goal using a plurality of hooks. Such an arrangement requires additional setup time for attaching the net and may also provide an undesirable hazard arising from numerous hooks on the frame of the goal.

An important issue not directly addressed in previous designs is how to configure a goal that can withstand the force of a player grasping and hanging from the crossbar—a behavior often seen on the soccer field. Under some designs a goal may suddenly fail under such a force. The potential danger to the player of a sudden failure is evident. Other goals may permanently bend under a strong downward force, resulting in damage to the goal; the undesirability of this alternative is equally evident.

An additional factor in considering desirable features for a portable soccer goal is the fact that many of the available playing surfaces are uneven or sloped. Goals that focus primarily on a rigid structure may not be sufficiently adaptable to mount stably in an upright position on an uneven or sloping surface.

SUMMARY OF THE INVENTION

One object of this invention is to provide a soccer goal allowing very rapid and simple setup, not requiring the use of any loose fasteners to join the pieces together, nor hooks to attach the net to the goal.

Another object of this invention is to provide a soccer goal having versatility for installation on uneven playing surfaces while maintaining the soccer goal erect and stable on such uneven surfaces.

Yet another object of this invention is to provide a lightweight portable goal with a folding crossbar wherein the crossbar will neither be damaged nor suddenly and dangerously fail in the event a player should attempt to hang therefrom.

An additional object of this invention is to provide a soccer goalpost combinable with several supporting configurations. The goalpost itself, however its rearward support is configured, has many of the desirable simplicity, portability, and safety features mentioned above.

It is a further object of this invention to provide a simple method for rapidly and stably erecting a soccer goal on a playing surface.

The invention provides a folding soccer goal, consisting of a goalpost, a backstay, and a net. The goal can be set up without tools or separate fasteners to join the segments together. Likewise there are no required tools or fasteners for attaching the net to the goal. The goal also folds to a portable size to fit in a trunk or back seat of a car, and conveniently fits into a bag for carrying.

In addition to the goal's light weight, ease of use, and portability, the design further allows a sturdy, safe, full-size configuration. It is also adaptable for use even on somewhat sloped playing surfaces.

The goalpost includes a horizontal crossbar and two vertical posts. The crossbar may be hinged along its length, and the hinge may both permit folding and provide a safety feature. The safety hinge allows the crossbar to gradually collapse without breaking if a player attempts to grasp and hang from the goal. The safety hinge may be reinforced with a breakaway sleeve to prevent any tendency to sag in long configurations of the crossbar, while preserving the safety feature of allowing the crossbar to slowly collapse when a significant downward force, such as a person's body weight, is applied to the crossbar. This safety hinge feature also prevents damage to the goal that players could otherwise cause by hanging from the crossbar. The crossbar may also be equipped with a locking hinge, such as a deadbolt hinge.

Each vertical post connects to the crossbar via hinges or other flexible or folding attachments. Alternatively, the crossbar may have a modular connection with the posts. Each vertical post also has at its base a hinged foot assembly, consisting of a hinge and a foot. The assembly may be integral with the post, or it may have a modular connection to the post. The hinge allows the foot to pivot so that the foot may be easily fastened to a playing surface as part of anchoring and erecting the goal. The hinges may have snap or locking features that prevent the goalpost from leaning forward after the posts are raised to the vertical position. A fixed spike, or a tracked or housed spike, may also be part of the foot assembly, allowing a mode of fastening the foot to the playing surface without the goal having any loose parts. The vertical posts may themselves fold, and may include one or more locking hinges along the length of the posts.

The backstay provides support to the rear of the goalpost, and consists of two backstay bars that connect to the goalpost, either on or near the joint that connects the crossbar with the vertical posts. This connection is again via hinges or other flexible or folding attachments, or it may be a modular, detachable connection. The backstay bars extend outward and downward from their attachment to the goalpost, and may have integral or modular spiked feet or fastening the backstay to the playing surface. Alternatively, the backstay bars may provide a contact pad for frictionally contacting the playing surface.

The backstay bars may each consist of two or more segments whose ends may articulate by sliding together. The segments may also be joined with locking hinges, such as deadbolt hinges, or with other flexible or rigid joint configurations. One or more regions of a backstay bar may flex or bend to achieve the desired position and suspension of the net. Backstay bars with flexible regions may be used to allow installation of the goal on an uneven surface without displacing the goalpost from its desirable vertical position.

The soccer goal may also have a base frame, consisting of side supports and a rear support. The side supports connect to the vertical posts and to the backstay bars, and the rear support runs between the backstay bars along the back of the goal. The base frame may be detachably connected to the soccer goal, or it may connect via hinges or other foldable attachments to the vertical posts. The side and rear supports may have contact pads for frictionally contacting a playing surface, or they may provide guides for receiving spikes or other connectors for stable attachment of the base from to a playing surface, or the supports may provide both contact pads and connector guides.

The net may be of any material suitable for use in a soccer goal, and may be permanently attached to the goal. This feature eliminates the need for potentially dangerous hooks or multiple fastening steps, further enhancing the safety and simplicity of erecting and using the goal.

The invention also provides a soccer goalpost, whatever the configuration of any additional part of the goal. The goalpost is the front part of the goal consisting of the crossbar and the vertical posts. The safety, portability, and ease of erection features of the goalpost, as discussed above, may be combined with any variety of rearward supports, nets, and bases.

The invention also provides a stabilized hinge system for a soccer goal, consisting of any hinged part of a soccer goal, together with a breakaway sleeve to stabilize the hinge. The stabilized hinge may thus be part of a foldable crossbar, a vertical post, or a backstay bar.

The soccer goal may be stabilized on uneven terrain by attaching a shock cord to flexible backstay bars and to the goalpost. The flexible backstay allows variable positioning of the feet of the backstay bars, depending on the contours of the playing surface, and the shock cord provides tension that stabilizes the goalpost in a upright position. The shock cord may attach near the bottom of the flexible backstay bars and to the crossbar, or near the top of the vertical posts.

Also part of the invention is a method for erecting a soccer goal on a playing surface. The goalpost is first laid horizontally on the playing surface. The feet of the hinged foot assembly are then placed against the playing surface by opening the hinges at the base of each post. The feet are attached to the playing surface, and then the posts are elevated to a vertical position, thus elevating the entire goalpost. Alternatively, the modular foot assembly may be attached first to the playing surface, then to the vertical post.

The feet may be attached to the playing surface by driving one or more spikes through each foot, or by inserting in the playing surface spikes that are an integral part of the foot. They may also be attached in several other ways including, on some surfaces, articulating with a permanent fastener integral with the playing surface.

The playing surface may be a turf playing field or a lawn. It may also be sand, dirt, clay, concrete, asphalt, hardwood, and the like. A goal may also be attached by this method to ice or other surfaces for use as a hockey goal.

Stability of goals erected by this method may be further enhanced with the use of backstay bars. The backstay bars may have spiked feet, or they may have feet with a nonslip contact pad or a tractioned surface. The backstay feet may also be capable of articulating with a permanent fastener integral with the playing surface. Goal stability may also be achieved by connecting shock cords from the lower part of the backstay bars to the crossbar or the upper part of the vertical posts. Additional stabilization of the goal may be realized with use of locking mechanisms on the hinges at the feet of the vertical posts.

BRIEF DESCRIPTION OF THE DRAWINGS

The invention will be more readily understood with reference to the accompanying drawings, in which.

DETAILED DESCRIPTION OF THE PREFERRED EMBODIMENT

Figure 1:
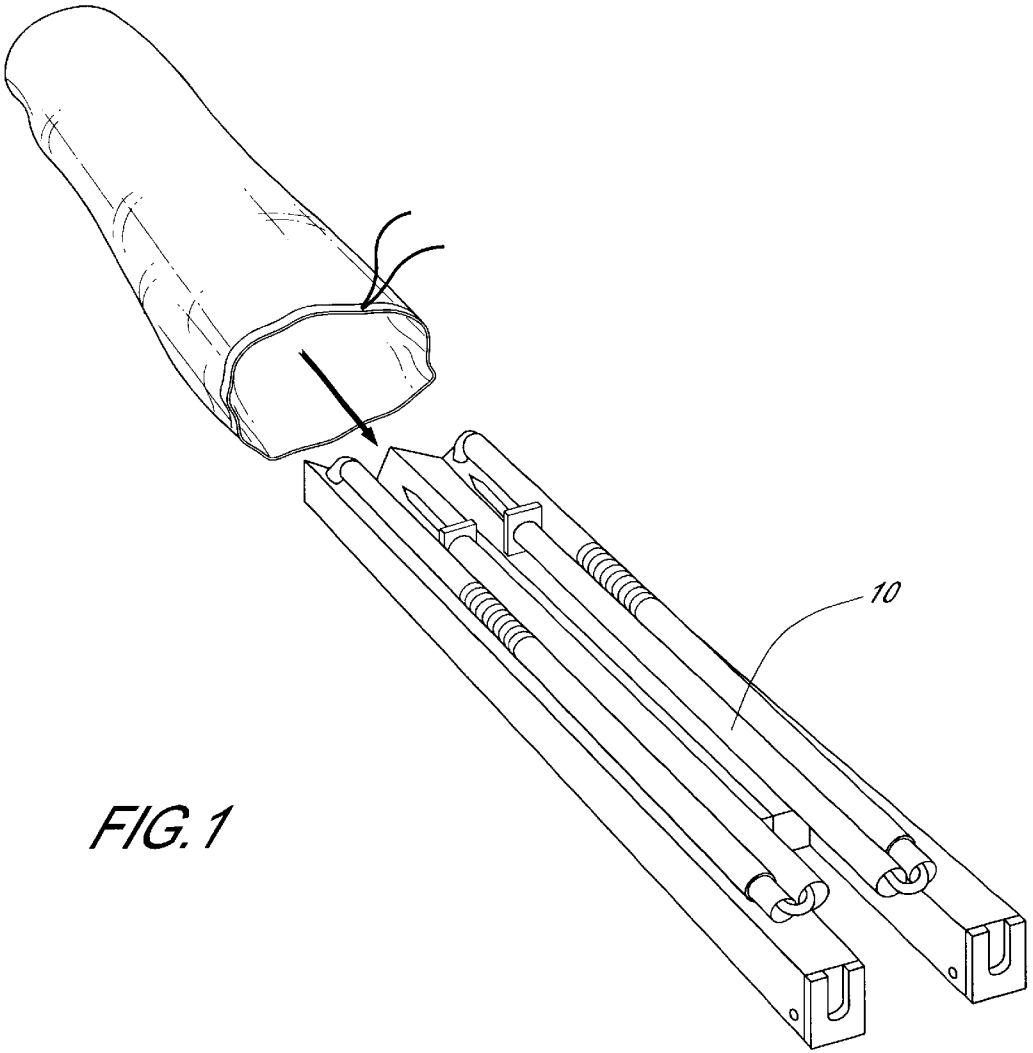
FIG. 1 is a perspective view of one embodiment of the fully folded soccer goal.
Figure 2:
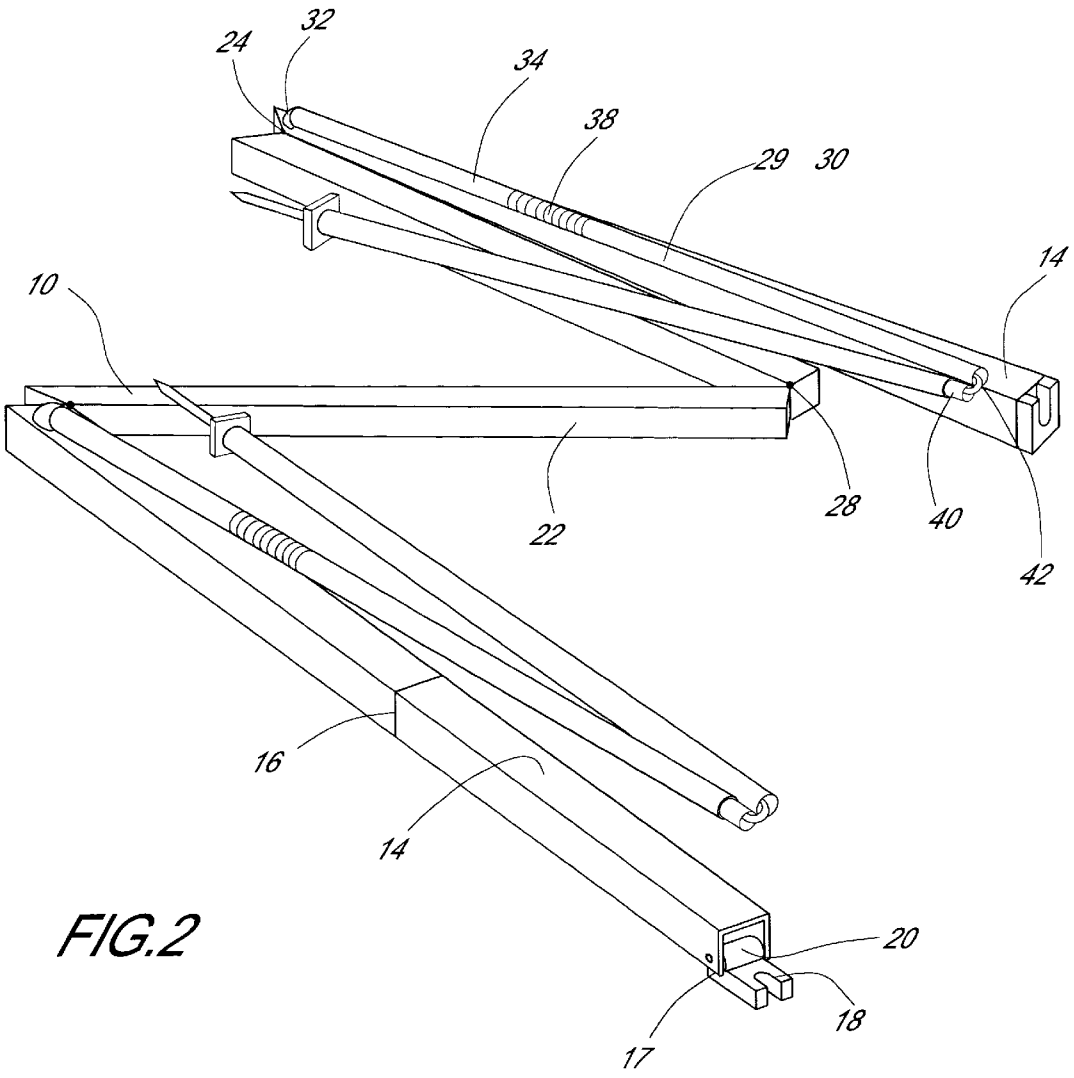
FIG. 2 is a perspective view of the soccer goal of FIG. 1 partially unfolded.
Figure 4:
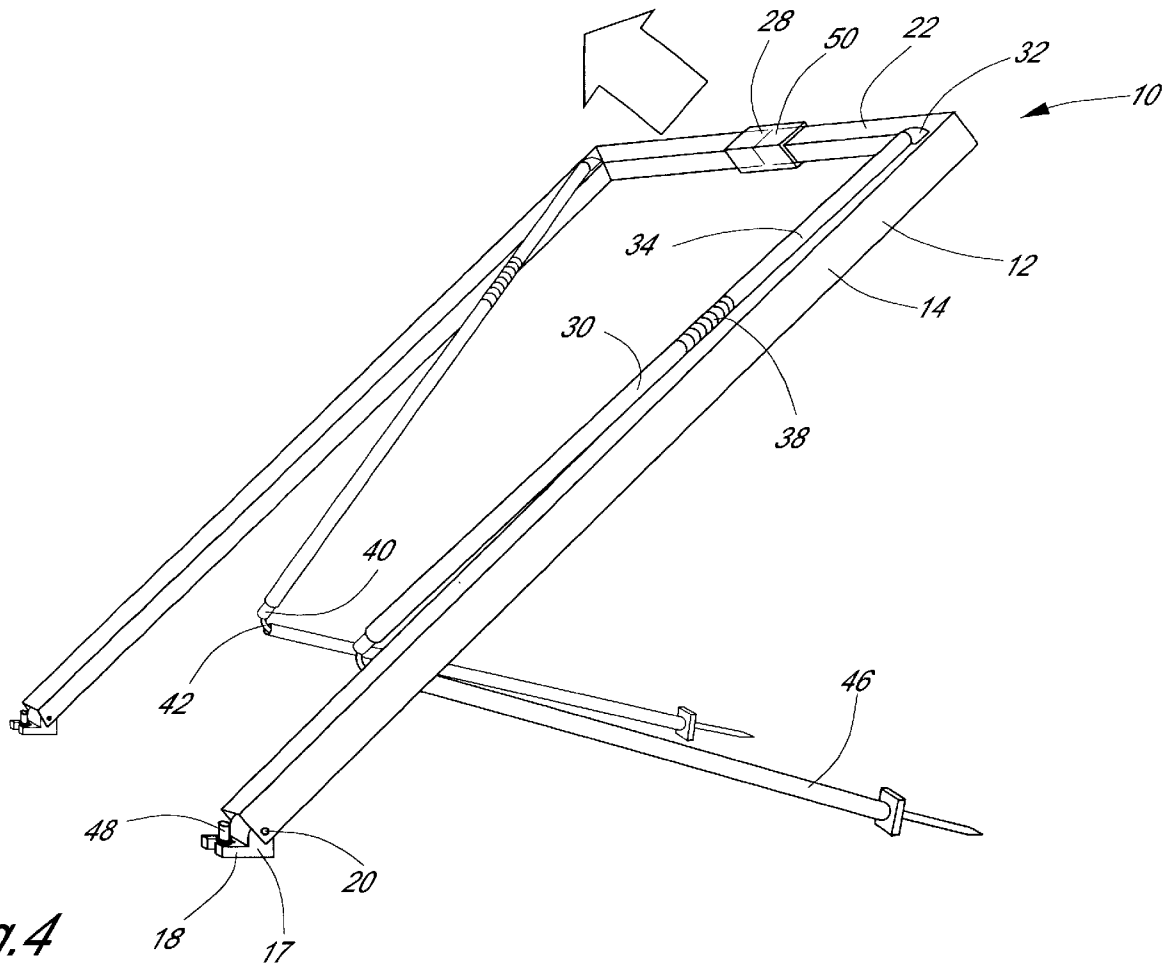
FIG. 4 is a perspective view of the soccer goal of FIG. 1 in an intermediate stage of elevation to the vertical position.
Figure 5:
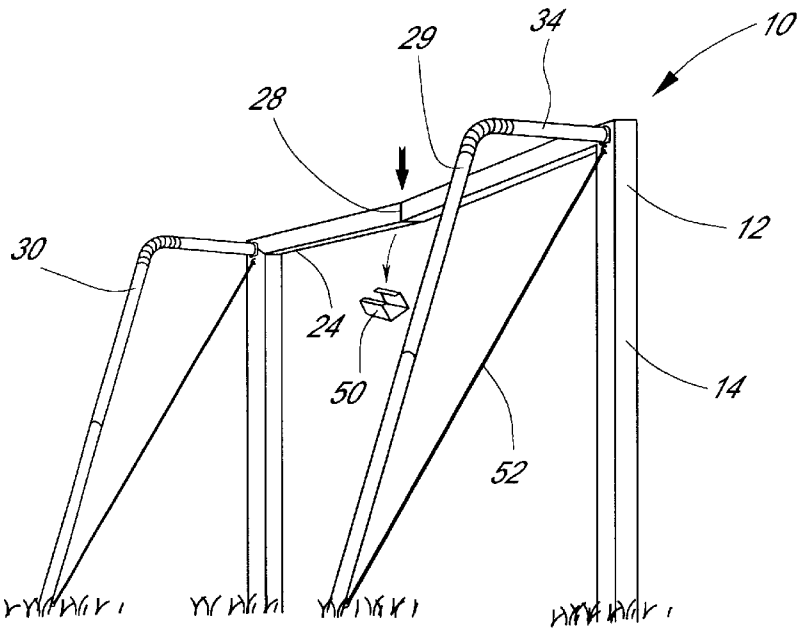
FIG. 5 is a perspective view of one embodiment of the fully erected soccer goal, receiving a downward force on the crossbar.

Referring now to the drawings, the portable soccer goal of the invention is generally indicated by reference numeral 10. The portable soccer goal 10 is constructed in a foldable manner, as shown in FIG. 1, and can be collapsed and inserted into a carrying bag, as shown in FIG. 1. The goal 10 has several hinged or articulating parts as shown in FIG. 2. The goal 10 can be described as having two primary structural units: the goalpost 12 and the backstay 29. (FIGS. 2, 4, and 5.)

Figure 3:
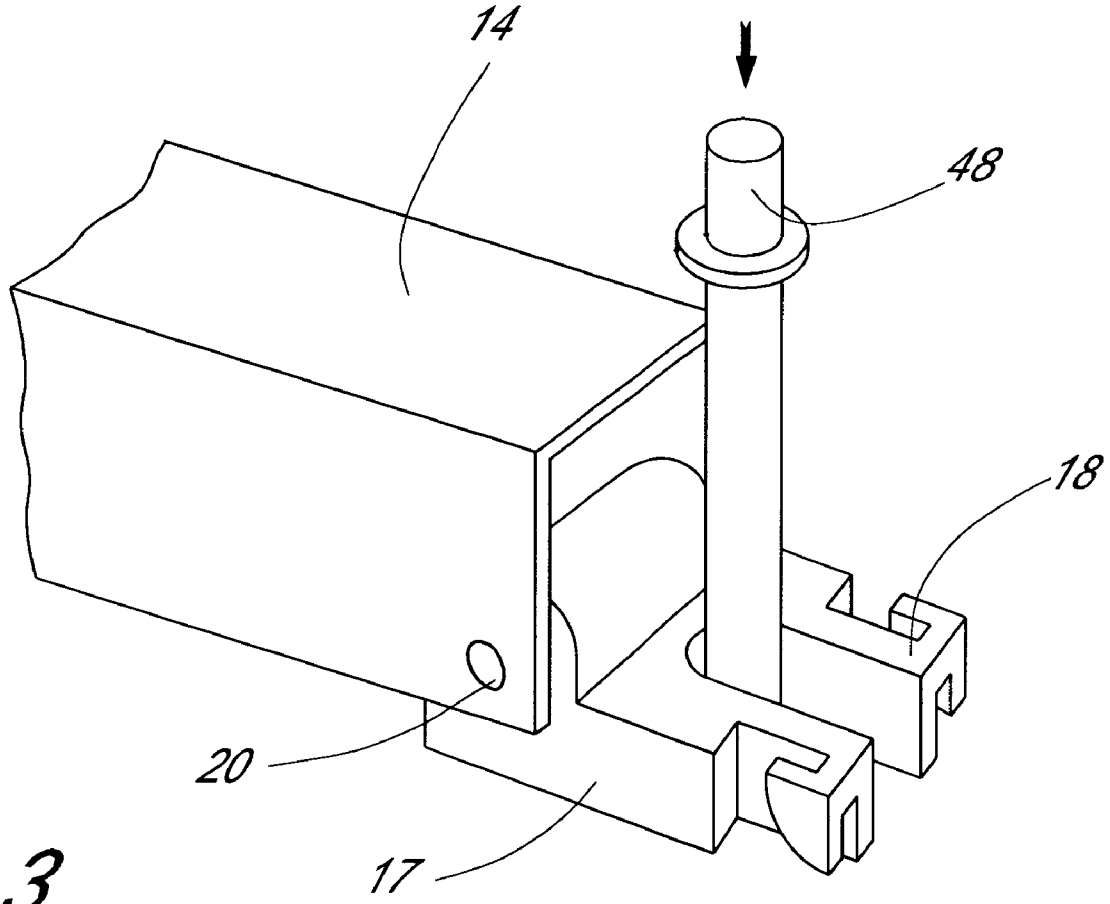
FIG. 3 is a detail view of one embodiment of the hinge and foot of the vertical post.

The goalpost 12 is the front part of the goal 10 in its fully assembled orientation, and consists of two vertical posts 14. Each vertical post has at its base a hinged foot assembly 17, that includes a post foot 18 and a base hinge 20. The foot 18 is adapted for attaching to a playing surface by receiving a spike 48, as shown in FIG. 3. The vertical posts 14 are connected at their upper ends to the horizontal cross bar 22 via goalpost hinges 24. The horizontal cross bar has a safety hinge 28. (FIGS. 4 and 5.)

The backstay 29 attaches to the goalpost 12 at backstay hinges 32 that connect the backstay bars 30 to the goalpost 12. (FIG. 4.) Each backstay bar 30 has an upper segment 34 and a lower segment 46. In the upper segment 34 a flexible region 38 allows adjustable bending of the backstay bars 30 to accommodate various kinds of terrain. (FIGS. 4 and 5.)

The upper segment 34 and the lower segment 46 are joined by an articulating joint 40. In one embodiment this joint 40 includes a stretch cord 42 that holds the segments together prior to their articulation and provides tension to the joint 40 after the segments are joined. (FIG. 4.) The lower segment 46 of the backstay bar 30 attaches to the playing surface with a spiked foot 44.

Figure 7:
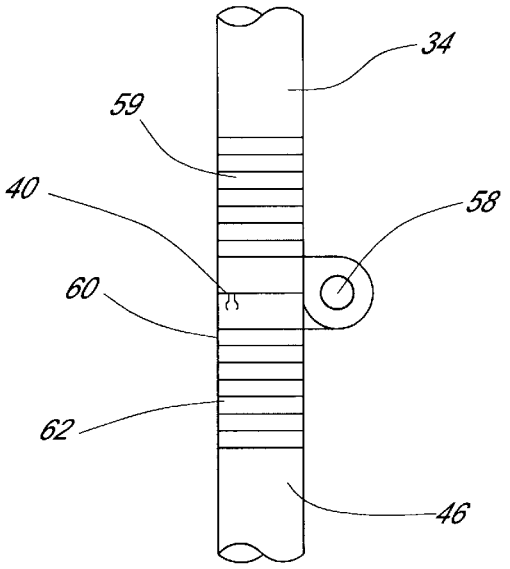
FIG. 7 is a detail view of an additional embodiment the backstay bar wherein the segments are hinged.
Figure 8:
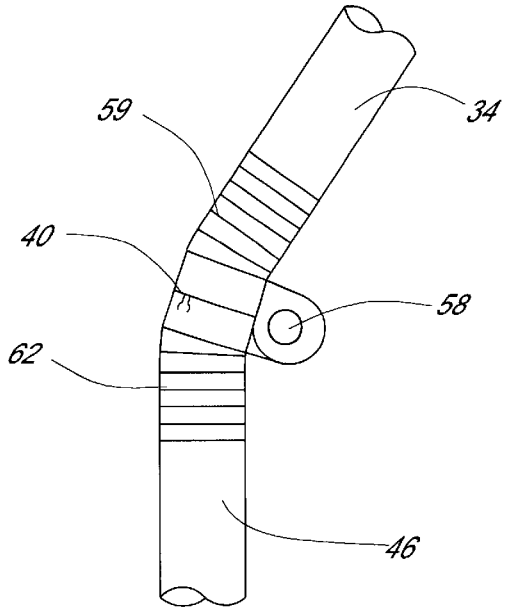
FIG. 8 is a detail view as in FIG. 7, showing the flexibility of regions flanking the hinge.
Figure 9:
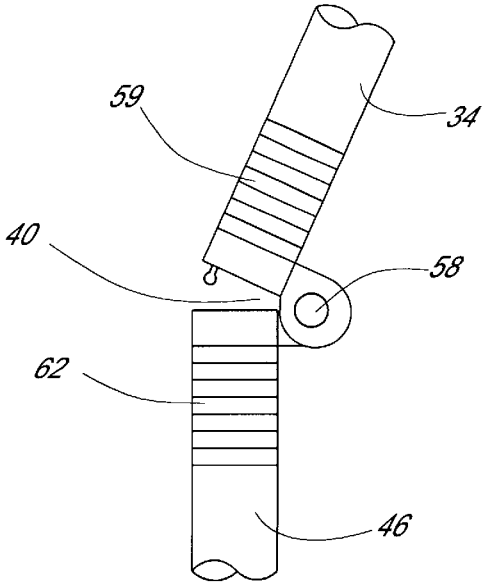
FIG. 9 is a detail view as in FIG. 8, showing the releasably locking character of the hinge.
Figure 10:
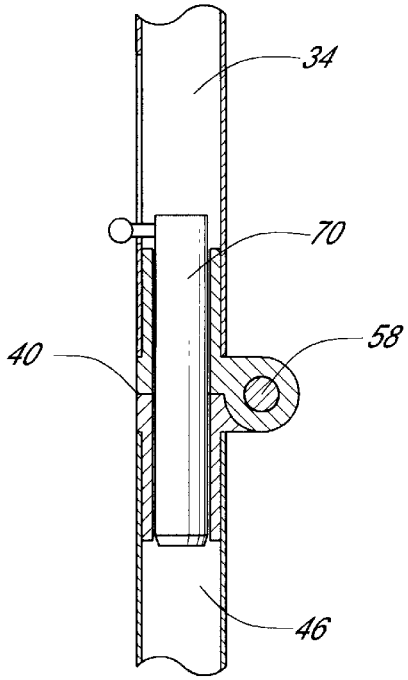
FIG. 10 is a detail cross-sectional view of a goal member showing a deadbolt hinge.
Figure 11:
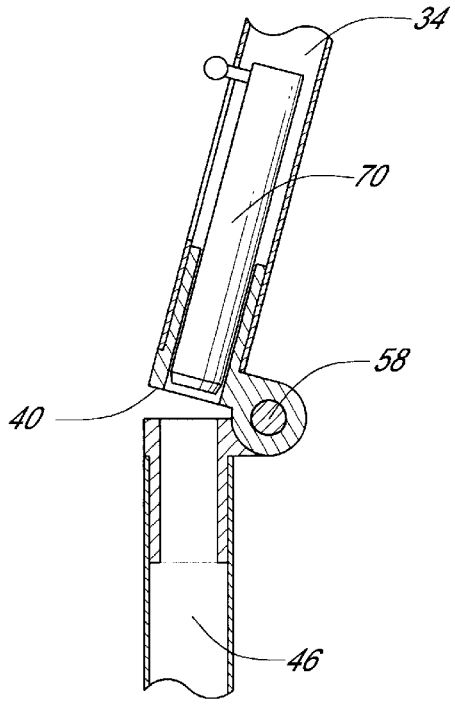
FIG. 11 is a detail cross-sectional view as in FIG. 10, wherein the deadbolt is withdrawn into the upper segment of the goal member, permitting opening of the hinge.
Figure 12:
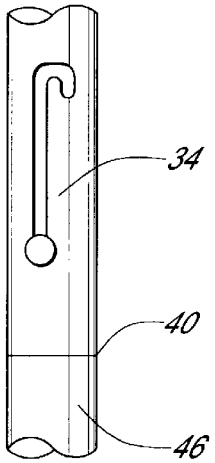
FIG. 12 is a detail view of a hinged goal member, showing the exterior of the member with the deadbolt hinge in a locked position.

In an alternative embodiment, the articulation of the upper and lower segments 34 and 46 of the backstay bars 30 is accomplished using a locking hinge 58. The locking hinge 58 is flanked by flexible regions 60 and 62 of the upper and lower backstay bar segments 34 and 46, as shown in FIGS. 7–9. The locking hinge 58 may also be a deadbolt hinge, as shown in FIGS. 10–12.

Setup of the goal 10 involves the steps of laying the goal 10 on the playing surface and unfolding the segments as shown in FIG. 2. When the segments are unfolded and the goalpost 12 is lying flat on the playing surface, the post foot 18 is placed against the playing surface by rotating it about the base hinge 20. With the post foot 18 in full contact with the playing surface, a goalpost spike 48 may be driven through the post foot 18 to anchor it to the playing surface, as shown in FIG. 3, or the foot 18 is otherwise secured to the playing surface. When both post feet 18 are securely anchored against the playing surface, the goalpost 12 is elevated to a fully upright position, as shown in FIG. 4.

With the goalpost 12 in a thus erected, the backstay bars 30 are positioned on the playing surface to accommodate any irregularities of terrain, and the spiked feet 44 are driven into the surface. The fully anchored goal 10, as shown in FIG. 5, may be further stabilized by shock cords 52 which connect the upper end of the goalpost 12 with the lower end of the backstay bars 30.

A breakaway sleeve 50 may be used to stabilize the safety hinge 28 of the cross bar 22 by sliding over and covering the safety hinge 28, as shown in FIGS. 4 and 5. If a sufficient downward force is applied to the cross bar 22 the breakaway sleeve 50 distorts and disengages the cross bar 22, falling away and allowing further gradual collapse of the cross bar 22 by the opening of the safety hinge 28.

Figure 6:
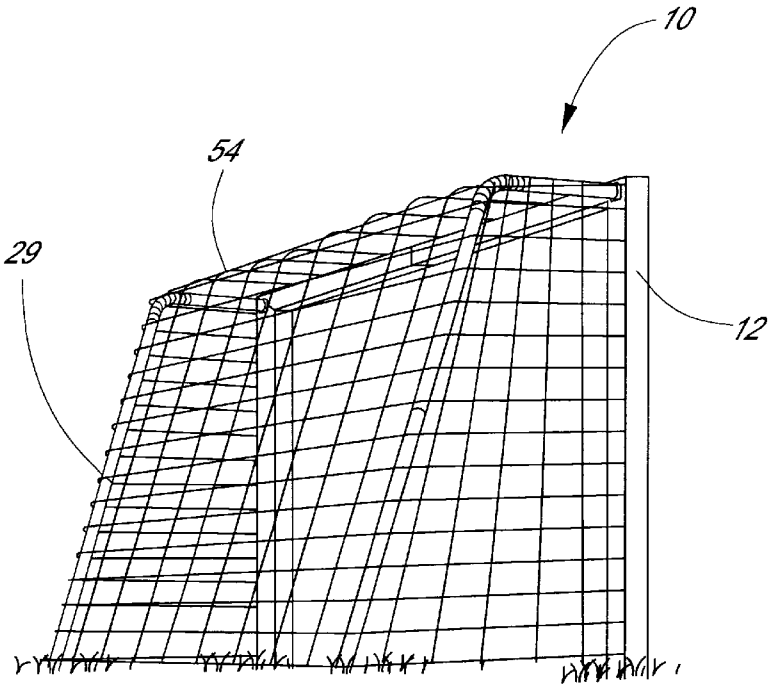
FIG. 6 is a perspective view of one embodiment of the fully erected soccer goal showing the net in place; all other drawings have omitted the net to more clearly depict other structures of the goal.

FIG. 6 shows the soccer goal 10 with the net 54 in place. The net 54 is permanently attached to the goalpost 12 and the backstay bars 30 and need not be separately attached with each setup. However, the net 54 has been omitted from the other Figures in order to facilitate an explanation of the parts and their interactions.

Figure 14:
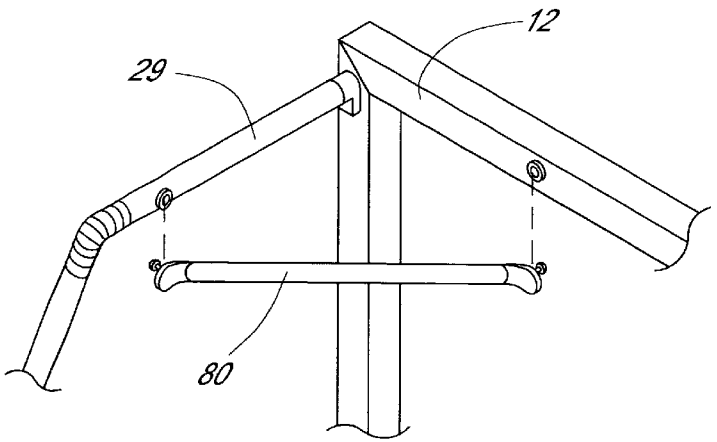
FIG. 14 is a detail view of the area described by the curved arrows in FIG. 13, showing one mode of attaching the diagonal brace to the goalpost and the backstay.
Figure 13:
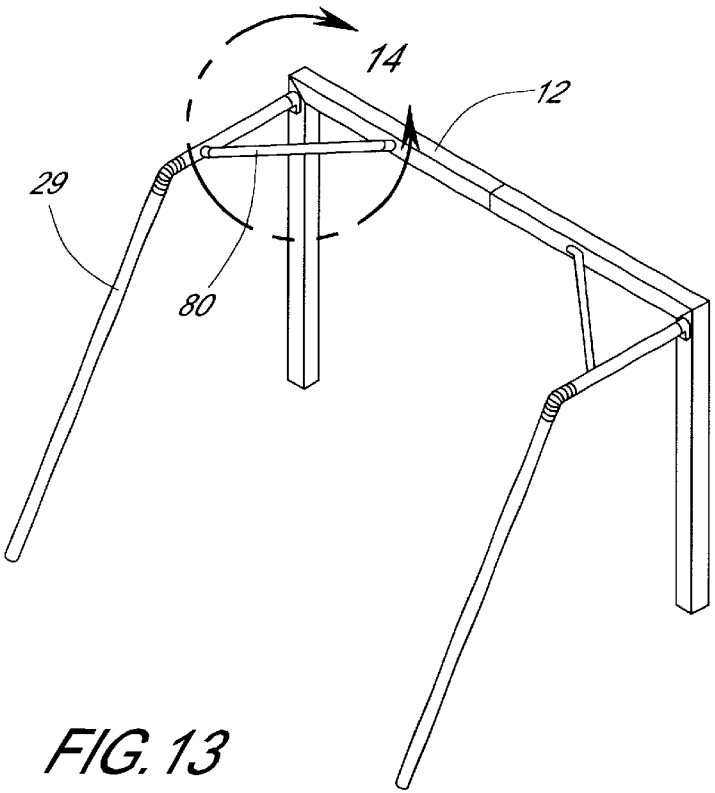
FIG. 13 is an elevations perspective view of the soccer goal, showing the diagonal brace connecting the goalpost and the backstay.

The goal 10 may be further stabilized with use of a diagonal brace 80, connecting the goalpost 12 and the backstay bar 30, as shown in FIGS. 13 and 14.

Figure 16:
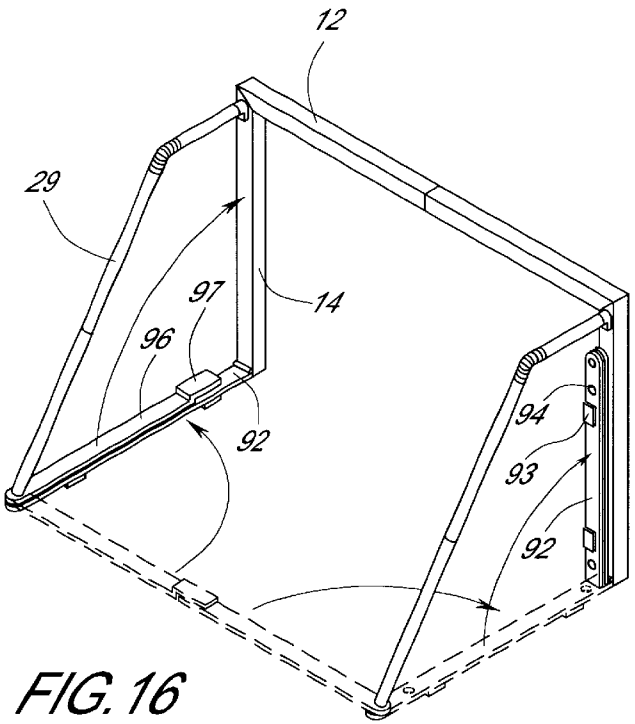
FIG. 16 is an elevational perspective view of the soccer goal, showing the partially folded base frame hingeably attached to the goalpost.
Figure 15:
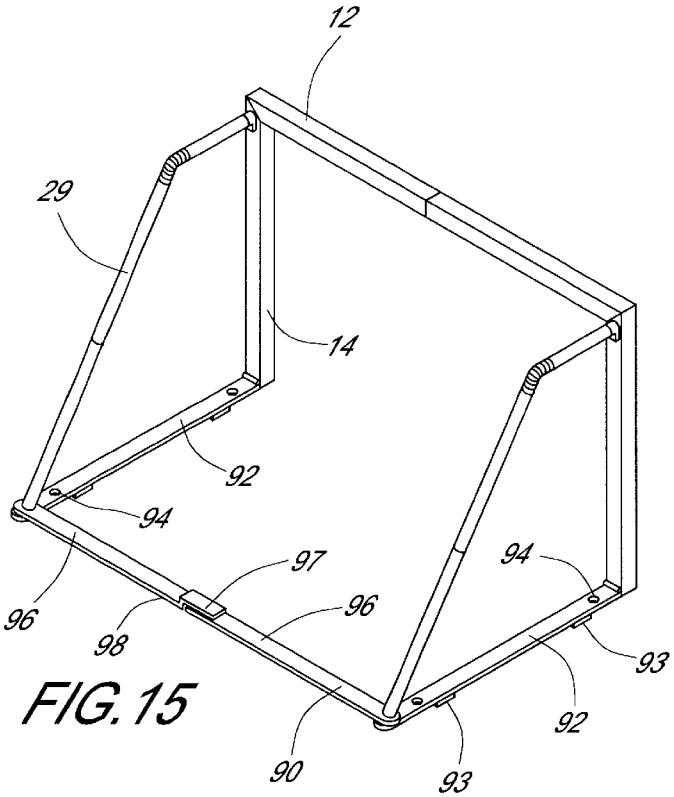
FIG. 15 is an elevations perspective view of the soccer goal, showing the relationship between the base frame, the goalpost, and the backstay.

An alternative embodiment of the invention provides a base frame 90, as shown in FIGS. 15 and 16. The base frame 90 has side supports 92 and a rear support 98. The rear support 98 includes two joining segments 96 that meet and articulate at their joining ends 97. Both the side supports 92 and the rear support 98 may have contact pads 93, for frictionally contacting a playing surface, or connector guides 94, for receiving connectors such as spikes. Alternatively, the base frame may have both contact pads 93 and connector guides 94.

The invention contemplates several possible size configurations of the goal 10, including as preferred embodiments a 5 foot by 8 foot configuration, a 6 foot by 12 foot configuration, and an 8 foot by 24 foot configuration. Dimensions provided are height by width of the goalpost 12. It is further contemplated that other uses, e.g., sand soccer, youth soccer, field hockey, lacrosse, street hockey, ice hockey, and handball may require different dimensional configurations. However, the invention encompasses these varied sizes and configurations and uses. The preferred use of square beams for the goalpost 12 provides great structural rigidity even with the use of lightweight materials such as aluminum or plastic.

The goalpost 12 includes a horizontal crossbar 22 and two vertical posts 14. The crossbar 22 may be hinged along its length; the hinge allows the crossbar 22 to be folded and also may function as a safety feature. The preferred embodiment has a safety hinge 28 in the center of the crossbar 22. The safety hinge 28 opens downward in a gradual fashion, with resistance to opening being provided either by a counter force-type spring, or by a series of stop positions on the hinge 28, each of which must be overcome by additional force. Resistance to opening may also be provided by an alternative hinge structure that includes a shock cord or a flexible or deformable material.

The preferred safety hinge configuration allows for the goal 10 to gradually collapse upon application of a significant downward force, e.g., when a player attempts to grasp and hang from the goalpost 12. Because the safety hinge 28 opens downward, the crossbar 22 collapses, mitigating the pressure applied by the force.

The optimal amount of resistance to opening to be provided by the safety hinge 28 is determined based on the weight of the crossbar 22, the rigidity of the material, and the likely weight range of players using a given goal size. The resistance is selected to not allow the safety hinge 28 to open under the normal torque of the crossbar's hanging weight alone, but to collapse under the addition of a force less than the force that would be required to distort the structure of the crossbar 22 in the absence of such a safety hinge 28. Appropriate values for any particular combination of hinge 28 and crossbar 22 can be calculated or readily determined by empirical methods. Therefore, any downward force applied will either be insufficient to damage the crossbar 22 or will cause the crossbar 22 to gradually collapse. A useful range of downward forces, depending on the dimensions and materials of the goal, may be from about 5 pounds to about 200 pounds. A preferred range is from about 10 pounds to about 150 pounds. A more preferred range is from about 15 pounds to about 100 pounds. Most preferred is a range from about 20 pounds to about 50 pounds.

In one preferred embodiment of the invention the crossbar 22 is 12 feet long, and the torque at the central hinge 28 of a hanging crossbar 22 of that length may create difficulties with reaching the desired force compromise discussed above. This can be overcome with use a breakaway sleeve 50, made of an elastic material such as nylon, polyethylene, polypropylene, polyvinylchloride, steel, aluminum, or other material that is capable of temporary partial distortion of its original shape. The breakaway sleeve 50 is designed to wrap around part of the crossbar 22 while leaving a portion thereof uncovered.

In a preferred embodiment where the crossbar 22 is a square beam, the breakaway sleeve 50 has three sides that reach around three sides of the square beam. On the fourth side of the square beam the breakaway sleeve 50 provides flanges that extend partially across the fourth side without entirely covering the fourth side. This sleeve 50 is slidable on the crossbar 22; during setup and breakdown the sleeve 50 can be positioned at an end of the crossbar 22 near one of the vertical posts 14, and then can be moved into place to cover the safety hinge 28 when the crossbar 22 is straightened and before the goalpost 12 is erected.

The breakaway sleeve 50, by fitting over the safety hinge 28, thus counteracts the sagging tendency that may exist in longer configurations of the crossbar 22. Its distortability characteristics, the tightness of its fit around the crossbar 22, and the length of the flanges that extend onto the fourth uncovered side of the crossbar 22, all combine to determine the load resistance of the crossbar 22 with the sleeve 50 in place. A useful range of load resistances provided by the breakaway sleeve 50, depending on the dimensions of the goal, may be from about 20 pounds to about 250 pounds. A preferred range is from about 25 pounds to about 180 pounds. A more preferred range is from about 30 pounds to about 120 pounds. Most preferred is a range from about 35 pounds to about 70 pounds The invention contemplates the use of similar breakaway sleeves in other embodiments, such as with a tubular cylindrical configuration of the crossbar. In such a tubular configuration, the breakaway sleeve can be a partial cylinder, and the angular proportion of the crossbar left uncovered will in part determine the load resistance of the cylindrical crossbar. The invention also contemplates other uses of the breakaway sleeve 50, including on folding vertical posts 14 and on backstay bars 30, where required by the various embodiments of this invention. The breakaway sleeve 50 is easily repositioned on the crossbar 22 as part of re-erecting a collapsed crossbar 22. The invention also contemplates other configurations o)f the breakaway sleeve 50, such as a breakaway sleeve that only contacts the square beam along the underside for most of its length and has rings at either end or positioned along its length to grasp the remainder of the crossbar 22. Additionally, the invention contemplates configurations of the breakaway sleeve 50 wherein a first end of the sleeve 59 grasps the crossbar 22 less tightly than the second end of the sleeve 50. In such a configuration, application of a sufficient downward force causes the first end to release from the crossbar 22, while the second end remains attached. In this way, the sleeve 50 breaks away from surrounding the safety hinge 28, allowing the crossbar 22 to gradually collapse, but the sleeve 50 does not become fully detached from the crossbar 22.

The breakaway sleeve 50 may also be adapted for use in stabilizing other hinges of the soccer goal 10. For example, in an embodiment of the goal in which the vertical post 14 includes two or more segments, it is desirable that the vertical post 14, once erected, be stable in its hinged regions. Accordingly, a breakaway sleeve 50 may be positioned over such hinges to stabilized them, and to provide strength to the vertical post 14. The load resistance parameters of breakaway sleeves 50 to be used on, for example, vertical posts 14 and backstay bars 30, may be determined according to the particular dimensions and intended use of a given goal 10. Such determinations may be routinely made by a person of ordinary skill in the art. A useful range of load resistances provided by this embodiment of the breakaway sleeve 50, depending on the dimensions of the goal 10, and the particular goal member whose hinges are reinforced by a particular sleeve, may be from about 20 pounds to about 250 pounds. A preferred range is from about 25 pounds to about 180 pounds. A more preferred range is from about 30 pounds to about 120 pounds. Most preferred is a range from about 35 pounds to about 70 pounds.

An alternative embodiment of the invention provides a hinged crossbar 22 wherein the hinge is a releasably locking hinge. The hinge of this embodiment is locked to stabilize the crossbar 22, and may be released to facilitate breakdown and folding of the goal 10 after use. A preferred releasably locking hinge has a deadbolt 70 configuration. (See FIGS. 10, 11, and 12.) The deadbolt 70 consists of a solid or rigid hollow structure slidably mounted within the hollow square beam or round beam of the crossbar 22. In one position, the deadbolt 70 is withdrawn into a region of the crossbar 22 on one side of the hinge, such that, with the crossbar 22 in a fully or partially folded position, the deadbolt 70 does not protrude from inside the crossbar 22. Upon straightening of the crossbar 22 and alignment of the folding segments of the crossbar 22, the deadbolt 70 is advanced through the hinged portion such that it lies within the hollow center of both segments of the crossbar 22 on both sides of the hinge. Thus the sliding deadbolt 70 locks the hinge and prevents the crossbar 22 from folding.

Another preferred from of releasable lock on the crossbar hinge is a structure similar to the breakaway sleeve mentioned above, but of a more rigid construction. This locking sleeve is slidably mounted on the crossbar, and is adapted to slide along the crossbar to cover the hinge region when the crossbar segments are straightened and aligned. By sliding over the hinge, the sleeve prevents the hinge from pivoting, thus locking it into place. Because the locking sleeve is of a configuration and material that will not normally distort, the sleeve locks the hinge and stabilizes the crossbar under a wide range of forces that may be applied to the crossbar. In addition to the deadbolt hinge and the locking sleeve configurations of releasably locking hinges, there are several other kinds of releasably locking hinges known in the art, and a person of ordinary skill in the art will appreciate the types of hinges that may be applied to this embodiment of the invention.

The vertical posts 14 connect to the crossbar 22 via hinges 24 or other flexible or folding attachments. In one configuration, the crossbar 22 rests fully upon the vertical posts 14, with an outside hinge connecting the crossbar 22 to the vertical posts 14. In another configuration, the vertical posts 14 are hinged across their tops to the crossbar 22 which is thereby suspended from the hinges 24 attaching the crossbar 22 to the vertical posts 14. In a preferred embodiment, the crossbar 22 and the vertical posts 14 meet at a 45° angle with a hinge 24 in the angle. The hinges 24 may be locking or spring hinges. Other connections between the crossbar 22 and the vertical posts 14 are also contemplated as are other positions of attachment between the crossbar 22 and the vertical post 14. Such other connections include a shock cord or a length of other deformable or flexible material, a leather strap, or a strap composed of nylon or canvas webbing material. In an alternative configuration, the connection of the crossbar 22 to the vertical posts 14 may be modular, such as with a snap-locking connection instead of, or in addition to, a hinge 24.

The vertical posts 14 may be one-piece, or they may consist of multiple segments, hingeably connected together. Where the vertical posts 14 include post hinges 16, the hinges 16 may be releasably locking hinges, such as, for example, deadbolt hinges. Alternatively, the hinges 16 may be reinforced and locked by being encased in a sliding sleeve.

The vertical post 14 may have at its base a hinged foot assembly 17. This assembly 17 includes a base hinge 20 and a foot 18. The base hinge 20 allows the foot 18 to pivot so that the foot 18 may be easily fastened to a playing surface as part of erecting and anchoring the goal 10. The base hinge 20 allows for rotation of the foot 18 up to greater than 90°. The foot 18 must have sufficient dimensions to allow stable attachment to the playing surface.

In an alternative embodiment, the hinged foot assembly 17 is detachably connected to the bottom end of the vertical post 14. The detachable connection is preferably a modular snap-lock articulation. In this embodiment the foot 18 may be attached to the playing surface before the assembly 17 is attached to the vertical post 14, or the assembly 17 may be attached to the vertical post 14 prior to attachment of the foot 18 to the playing surface. Whether the hinged foot assembly 17 is integral with the vertical post 14 or is detachably connected thereto, the hinge 20 may be a locking hinge to stabilize the goalpost 12 in a substantially vertical position.

The feet 18 of the assembly 17 may be attached to the playing surface in a variety of ways. In a preferred embodiment a spike 48 is driven through an opening in the foot 18 into the playing surface. In another preferred embodiment of the invention, the spike 48 is tracked in the foot 18 to allow the vertical movement of the spike 48 through the foot 18 for anchoring, so that the spike 48 is part of an integrated foot 18 assembly. The orientation of the base hinge 20 provides stability to the goal 10. As demonstrated in FIG. 4, the preferred base hinge 20 opens toward the back of the goal 10, so that any impact on the front of the goal 10 will not cause the goal 10 to tip. In other embodiments, multiple spikes may be driven through the foot 18, or screws or augers may be driven through the foot 18 to anchor it to the playing surface. An additional embodiment of the hinged foot assembly 17 provides a foot 18 with a fixed spike or a plurality of fixed spikes protruding therefrom.

Also contemplated is attachment of the foot 18 to playing surfaces with buttons or bolt heads that are integral to the surface. Such attachment points are positioned to facilitate repeated setup and use of the soccer goal 10 of this invention in a particular spot on a playing surface. Such button or bolt head attachments may also be placed in ice for use of an embodiment of this invention in ice hockey, and may also be placed in playing surfaces such as hardwood, cement or asphalt for use in other games of soccer or hockey, e.g., in a gymnasium, in a street, or on a "blacktop" playground. Alternative button or bolt head attachments may be connected to an anchor structure and buried in sand or snow for quick and repeatable attachment of the goal to playing surfaces that may be insufficiently solid for stable attachment using spikes or augers.

The backstay 29 provides support to the rear of the goalpost 12, and consists of two backstay bars 30 that connect to the goalpost 12 with a backstay hinge 32, either on or near the joint that connects the crossbar 22 with the vertical posts 14. The backstay hinges 32 may be releasably locking hinges. The invention therefore contemplates attachment of the backstay bars 30 either onto the crossbar 22 or onto the vertical posts 14 or onto the junction of the crossbar 22 with the vertical posts 14. In some embodiments, the backstay bars 30 may attach to a portion or the vertical posts 14 below their uppermost end. In addition to the connection provided by the backstay hinge 32, the invention contemplates that the backstay bars 30 may also be connected to the goalpost by non-hinge connections such as detachably connecting modular snap-lock attachments, a shock cord, a length of other flexible or deformable material, and the like. The backstay 29 provides depth to the goal 10 for suspending the net 54 and also provides structural support for the goalpost 12 against impacts to the front of the goalpost 12.

The backstay bars 30 may consist of two or more segments whose ends may articulate by sliding together at an articulating joint 40. In one embodiment, the internal diameter of the lower segment 46 is matched with the external diameter of the upper segment 34 allowing a small gap sufficient for the articulation of the segments 34, 46. In such a configuration, a stretch core 42 is contained inside the tubular structure of the backstay bars 30 to hold the segments 34, 46 together prior to assembly and also to provide tension on the joint 40 after assembly.

In another embodiment, the segments 34, 46 of the backstay bars 30 are hinged together. A preferred embodiment of this hinge feature provides a releasable locking hinge 58, being flanked on either side by a flexible region 38 that allows flexing of the backstay bars 30 around the hinge 58, as shown in FIGS. 7–9. This flexing permits positioning of the backstay bar feet 44 in an optimal location on uneven terrain, as well as providing some ability to withstand a lateral impact on the hinge 58 by a player or a ball. As an alternative, the hinges 58 connecting the upper and lower segments of the backstay bars 30 may be deadbolt hinges, as discussed above, and as depicted in FIGS. 10, 11 and 12. The deadbolt-type hinges may also be flanked by flexible regions to allow the advantageous iterative positioning of the backstay bars 30, as discussed above.

In a preferred embodiment of the invention the upper segment 34 of the backstay bar 30 also has a flexible region 38. The flexible region 38 in the upper segment 34 allows the backstay bar 30 to connect to the vertical posts 14 at an angle that is not undesirably acute, and provides an internal dimension to the goal 10 very similar to regulation-type goals of the non-portable variety used at dedicated soccer venues. An additional advantage of the flexibility in the various regions of the backstay bars 30 is that the feet may be "walked" about to find an optimal position on a particular playing surface, to achieve the proper backstay 29 support and tension on the vertical posts 14.

The flexible regions 38 contemplated in a preferred embodiment include a ribbed structure of plastic, rubber, or a like flexible or deformable material, wherein rigid ribs are separated by thinner lengths of the material, allowing for the ribs to be closely aligned or to spread apart and create a flex. Additional strength and stability may be achieved by placing a hinge inside the ribbed structure. Flexibility in the backstay bars 30 may also be accomplished, for example, with use of a mechanical hinge with or without a flanking flexible region, a shock cord, a spring, or a length of flexible or deformable material.

The feet 44 of the backstay bars 30 are preferably spiked. These spiked feet 44 allow for anchoring of the backstay bars 30 in the desired position. The spikes may be either integral with the backstay bars 30 or they may be detachably connected to the backstay bars 30. The invention also contemplates other embodiments of the backstay bar feet 44 for other surfaces such as artificial turf, asphalt, carpet, clay, concrete, hardwood, ice, and synthetic court surfaces. Accordingly, the feet 44 of the backstay bars 30 may also have non-slip or tractioned surfaces of rubber and the like, weighted anchors, or a receptacle to interlock with a preplaced fastener such as is used on many multipurpose playing surfaces.

Some embodiments of the present invention may include a base frame 90. The base frame 90 may have two side supports 92 and a rear support 98. The side supports 92 may attach at one end to the goalpost 12, while attaching at another end to the backstay 29. This attachment may be via hinges connecting the side supports 92 to the bottom end of the vertical posts 14. Alternatively, the base frame 90 may be modular, detachably connecting with the vertical posts 14 and the backstay 29. With a modular base frame 90, the connection of the base frame 90 to the vertical posts 14 may be part of the hinged foot assembly 17, or the connection may replace the hinged foot assembly 17, or the connection may be made directly to the vertical post 14 above the hinged foot assembly 17.

The rear support 98 preferably has two joining segments 96. Each segment 96 may have a pivoting end that connects with the one of the side supports 92. This connection allows one joining segment 96 of the base frame 90 to pivot from a position parallel to the side support 92 to a position at about a 90° angle to the side support 92. Since this pivoting position constitutes a rear comer of the base frame 90, the preferred embodiment provides an articulation with the bottom end of one of the backstay bars 30 at or near the pivoting junction between the side support 92 and the joining segments 96 of the rear support 98 of the base frame 90. This articulation may provide a guide 94 through which a spiked foot 44 of the backstay 29 may pass, or it may, for example, provide a snap-lock receptacle into which ar. adapted bottom end of a backstay bar 30 may be inserted and releasably locked.

Each joining segment 96 of the rear support 98 thus, at one end, connects with and pivots about one end of one of the side support 92. At the other end of each joining segment 96 is a joining end 97 that is adapted to articulate with the corresponding joining end 97 of the other joining segment 96, such that when the two joining segments 96 are articulated at their joining ends 97, the rear support 98 provides a connection between the two backstay bars 30, and substantially contacts with the playing surface along the width of the rear part of the soccer goal 10.

The base frame 90, including both side supports 92 and the rear support 98, may contact the selected playing surface in a multiplicity of ways. In one embodiment, the contact with the playing surface is via spikes, and the base frame 90 provides guides 94 through which the spikes may be driven into the playing surface. When such spikes are driven through the guides 94, the base frame 90 is secured to the playing surface, thus likewise securing the soccer goal 10 thereto. In another embodiment, the contact with the playing surface is via contact pads 93. The contact pads 93 may adhere to the playing surface, for example by providing a hook and loop interaction with an appropriate playing surface such as a carpet. Attentively, the contact pads 93 may frictionally contact the playing surface, such as with flexible rubber contact pads 93 on asphalt or hardwood. In another embodiment, the contact pads 93 may provide slots for articulating with buttons or bolt heads in a playing surface such as, for example, hardwood, synthetic court material, ice, asphalt, and the like. The contact pads 93 may also themselves display bolt heads or buttons for articulating with receptacles in a playing surface designed to receive such bolt heads or buttons.

The net 54 may be of any material suitable for use in a soccer goal 10, and may be permanently attached to the goal 10. In a preferred embodiment the net 54 may be of nylon, polypropylene, or polyester material, and can be attached in six positions on the goal 10: one attachment near each of the feet of the backstay bars 30, one near the junction of the upper segment 34 of the backstay bar 30 with the goalpost 12, and one on each side of the crossbar 22 lateral to the safety hinge 28.

The permanent attachment of the net 54, according to this embodiment, facilitates ease and speed of setup and breakdown of the goal 10. The material of the net 54 does not add significant bulk to the soccer goal 10 in its folded configuration, and is compatible with inserting the soccer goal 10 into a carrying bag.

The invention also provides a soccer goalpost 12, whatever the configuration of any additional part of the goal 10. The goalpost 12 is the front part of the goal 10, having vertical posts 14 and a crossbar 22. The invention contemplates the use of a variety of backstays or other support means to brace the goalpost 12 and suspend the net 54, such as, for example, telescoping, flexible, modular or one-piece segments, with or without springs or hinges.

The primary elements of the goalpost 12 as a separate embodiment of this invention are the same as the elements described above with respect to the goalpost 12 as an integral part of the goal 10. They include vertical posts 14 with hinged feet 18 for attaching to a playing surface and a crossbar 22 attached to the vertical posts 14. A preferred embodiment of the goalpost 12 aspect of the invention also includes a safety hinge 28 and a breakaway sleeve 50.

The safety, portability, and ease of setup features of the goalpost 12, as discussed above, may accordingly be combined with any variety of rearward supports, nets, and bases, depending on the sport for which the use is adapted, the size configuration of the goalpost 12, the playing surface and conditions, and the needs of the user.

Another aspect of the invention provides a soccer goal support system adapted for an uneven playing surface. The system includes the goalpost 12 of the invention, as described herein, backstay bars 30 having at least one flexible region, and shock cords 52 attached to the backstay bars 30 and .he goalpost 12.

When a soccer goal 10 with this system of cooperating parts is erected on uneven teraain, the flexibility of the backstay bars 30 allows iterative positioning of the feet 44 of the backstays 29, adaptable to the conditions of the playing surface. The goalpost 12 may be attached to the playing surface as described herein and elevated to a substantially vertical position. Then the backstay bars 30 may be positioned so as to cause the shock cords 52 to provide the optimal tension on the goalpost 12, stabilizing the goalpost 12 in a substantially vertical position. In a preferred embodiment of the goal 10 of this system, one end of a shock cord 52 is attached near the foot 44 of each backstay bar 30, and the other end of the same shock cord 52 is attached near the top end of one of the vertical posts 14, or at a position on the crossbar 22. Alternatively, a multiplicity of shock cords 52 may be used, having several points of attachment on the goalpost 12 and the backstay bars 30, to optimally distribute the desire stabilizing forces, which may be adjusted by selecting a particular position on the uneven playing surface for attaching the feet 44 of the backstay bars 30. The invention also contemplates an arrangement of a multiplicity of shock cords 52 attached to the backstays 29 and the goalpost 12 such that the array of shock cords 52 constitutes, itself, the net 54 of the soccer goal 10.

Also contemplated as part of the invention is a method for erecting a soccer goal 10 on a playing surface. The method involves the use of vertical posts 14 having hinges 20 and feet 18. The feet 18 are attachable to the playing surface, by means of any of the attachments disclosed herein.

In the method of the invention, the goal 10 is laid on its face on a playing surface, the goal 10 having vertical posts 14 with hinges 20, the hinges 20 connecting the vertical posts 14 to attachment feet 18. The feet 18 are placed against the playing surface by rotating the hinges 20. The feet 18 are then securely fastened to the playing surface. The goalpost 12 is then elevated, so that the hinges 20 close and the vertical posts 14 are substantially vertical. In an alternative embodiment of the method of the invention, wherein the hinged foot assembly 17 is detachably connected to the vertical posts 14, the method includes the additional steps of detaching the assembly 17 from the post 14 prior to attaching the foot 18 to the playing surface. The assembly 17 is then connected to the post 14 after attaching the foot 18 to the playing surface.

The present invention contemplates the use of the invention on any suitable playing surface, suitable for games requiring a goal 10 such as all forms of soccer, field hockey, hockey, lacrosse, and handball. Accordingly the playing surface may be turf or a lawn. It may also be sand, dirt, clay, concrete, asphalt, ice, snow, hardwood, synthetic court surface material, artificial turf, carpet, and gravel.

For many of these playing surfaces where it may be desirable to repeatedly install and store a portable folding goal 10, fasteners may be installed in the surface suitable for articulating with adapted feet 18 of the vertical posts 14 and the backstay bars 30 of the goal 10 of the invention. Such adaptations of multipurpose playing surfaces are known in the art and will be appreciated by one of ordinary skill in the art.

Goal 10 stability according to the method of the invention may be enhanced by the use of backstay bars 30. Backstay bars 30 may have spiked feet 44, or they may have feet 44 with a non-slip or tractioned surface. The backstay feet 44 may also be capable of articulating with a permanent fastener integral with a playing surface. The hinges 20 at the feet 18 of the vertical posts 14 may also be locking hinges 20 so that when the vertical posts 14 are raised to a substantially vertical position, the hinges 20 lock, and the posts 14 may not rock forward without the hinges 20 being first unlocked. The feet 18 of the hinged foot assembly 17 may be attached to the playing surface by receiving a spike 48, or the feet 18 may have fixed spikes protruding therefrom.

Goal 10 stability may also be achieved by connecting shock cords 52 from the lower segment 46 of the backstay bars 30 to the crossbar 22 of the upper part of the vertical posts 14. Additional stabilization of the goal 10 may be realized with use of locking mechanisms on the hinges 20 of the hinged foot assembly 17.

While the foregoing is a description of certain embodiments of the invention, it is understood that the invention is not limited to the specific combination of parts, or to the methods, disclosed herein.

What is claimed is:

1. A portable folding soccer goal, comprising a one-piece goalpost, said goalpost comprising a foldable horizontal crossbar having a first end and a second end, and two vertical posts each having a top end and a bottom end, each vertical post foldably attached at its top end to one end of said crossbar, wherein said crossbar folds into at least two pieces at a junction of said pieces, and wherein the crossbar does not connect to a horizontal, rearwardly projecting support member at said junction, and wherein said crossbar and said vertical posts can fold into a conformation wherein all segments of said crossbar and said vertical posts are substantially parallel while remaining connected.

2. The soccer goal of claim 1 further comprising a net.

3. The soccer goal of claim 2 wherein said net is permanently affixed to said goal.

4. The soccer goal of claim 2 wherein said net comprises a stretchable material.

* * * * *